US005151036A

United States Patent [19]

Fusselman et al.

[11] Patent Number: 5,151,036

[45] Date of Patent: Sep. 29, 1992

[54] CONNECTORS WITH GROUND STRUCTURE

[75] Inventors: David F. Fusselman, Middletown; Peter K. Townsend, Camp Hill, both of Pa.

[73] Assignee: E. I. du Pont de Nemours and Company, Wilmington, Del.

[21] Appl. No.: 766,930

[22] Filed: Sep. 27, 1991

Related U.S. Application Data

[62] Division of Ser. No. 536,855, Jun. 8, 1990, abandoned.

[51] Int. Cl.[5] ..... H01R 4/66

[52] U.S. Cl. ..... 439/108; 439/608

[58] Field of Search ..... 439/81, 80, 607-610, 439/79, 108, 95

[56] References Cited

U.S. PATENT DOCUMENTS

| | | | |
|---|---|---|---|
| 4,451,107 | 5/1984 | Dola et al. | 339/143 |
| 4,568,134 | 2/1986 | DeMondi | 339/17 |
| 4,601,527 | 7/1986 | Lemke | 339/14 |
| 4,655,518 | 4/1987 | Johnson et al. | 339/17 |
| 4,686,607 | 8/1987 | Johnson | 361/413 |
| 4,806,107 | 2/1989 | Arnold et al. | 439/79 |
| 4,824,383 | 4/1989 | Lemke | 439/108 |
| 4,836,791 | 6/1989 | Grabbe et al. | 439/79 |
| 4,840,573 | 6/1989 | Seidel et al. | 439/92 |
| 4,846,727 | 7/1989 | Glover et al. | 439/608 |
| 4,867,690 | 9/1989 | Thumma | 439/79 |
| 4,869,677 | 9/1989 | Johnson et al. | 439/80 |
| 4,874,319 | 10/1989 | Hasircoglu | 439/608 |
| 4,898,546 | 2/1990 | Elco et al. | 439/608 |
| 4,914,062 | 4/1990 | Voltz | 439/608 |
| 4,952,172 | 8/1990 | Barkus et al. | 439/532 |
| 4,959,024 | 9/1990 | Czeschka | 439/607 |
| 4,959,626 | 9/1990 | Mouimie | 439/607 |
| 4,975,084 | 12/1990 | Fedder et al. | 439/608 |

FOREIGN PATENT DOCUMENTS

| | | | |
|---|---|---|---|
| 0365179 | 4/1990 | European Pat. Off. | 13/658 |
| 3904461 | 9/1990 | Fed. Rep. of Germany | 13/658 |

*Primary Examiner*—Larry I. Schwartz
*Assistant Examiner*—Hien D. Vu
*Attorney, Agent, or Firm*—John E. Griffiths

[57] ABSTRACT

The present invention relates to electrical connectors with a ground structure for impedance and cross talk control between signal carrying conductors.

5 Claims, 4 Drawing Sheets

CONNECTORS WITH GROUND STRUCTURE

CROSS REFERENCE TO RELATED APPLICATION

This is a divisional application of copending U.S. patent application Ser. No. 07/536,855 filed Jun. 8, 1990, now abandoned.

BACKGROUND OF THE INVENTION

1. Field of the Invention

This invention relates to electrical connectors with a ground structure for impedance and cross talk control between signal carrying conductors.

2. Description of Related Art

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. Nos. 4,655,518 (to Lennart B. Johnson et al.), 4,686,607 (to Lennart B. Johnson) and 4,869,677 (to Lennart B. Johnson et al.) disclose a daughter board-/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide high density electrical connectors for electrically and mechanically interconnecting electronic circuits and/or components controlling impedance and/or cross talk within the connectors.

Furthermore, it is an object of this invention to provide high density electrical connectors for electrically and mechanically interconnecting a circuit assembly and a plurality of terminals arranged in rows and columns in a mating connector to control impedance and-/or cross talk thereby to reduce, prevent or minimize degradation of signal transmission within the receptacles.

SUMMARY OF THE INVENTION

The present invention is directed to an electrical connector for electrically and mechanically interconnecting a circuit assembly having a plurality of contact regions and a mating connector having first side walls, a plurality of first contact portions arranged in rows and columns within the first side walls and at least one second side contact portion, the electrical connector comprising:

- a plurality of electrical contact elements wherein:
  - each of the contact elements has a first contact and a second contact,
  - the first contacts are arranged in rows and columns for contacting the first contact portions, and
  - each one of the contact elements includes a middle portion configured such that their second contacts extend at an angle or perpendicularly with respect to the first contacts,
- a housing including:
  - a conductive base having a plurality of passages arranged in rows and columns extending through the base, the contact elements positioned in the passages,
  - insulative blocks positioned in the passages, the blocks having passages, the contact elements in the block passages such that their first contacts are on a first side of the base in the contact region and their second contacts are on a second side of the base, and
  - a conductive baffle positioned between and spaced from columns of the middle portions of the contact elements, the baffles being connected to the conductive base.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
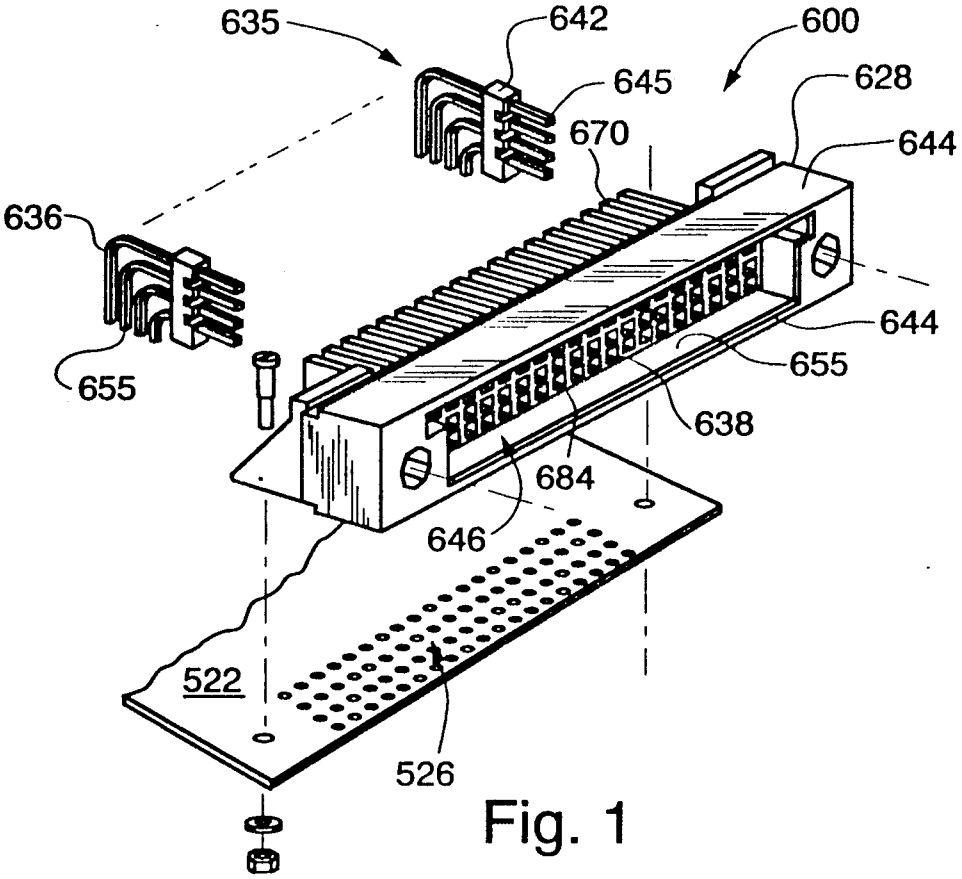
FIG. 1 is an exploded perspective view of a high density connector assembly in accordance with the present invention, the assembly including a high density angled or right angle connector for interconnecting a circuit assembly and a mating connector.

Throughout the following detailed description, similar reference characters refer to similar elements in all figures of the drawings.

Figure 6:
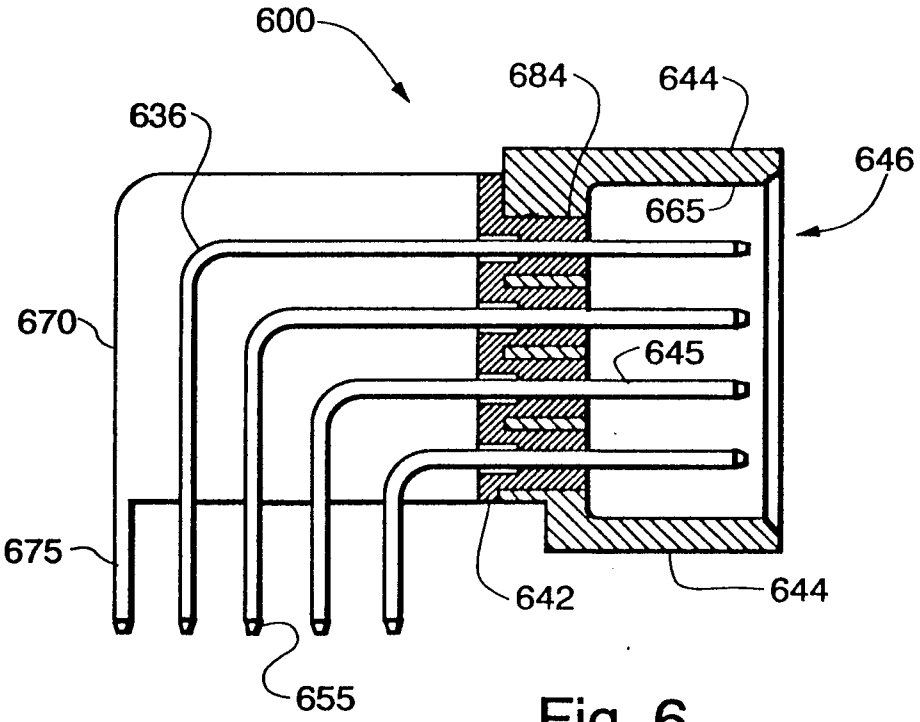
FIG. 6 is a sectional view of the angled or right angle connector of FIGS. 1-5.

Referring to FIG. 1, there is illustrated an exploded perspective view of a high density connector assembly in accordance with the present invention. The assembly includes a high density angled or right angle connector or header 600 for interconnecting a circuit assembly 522 and a mating connector (not depicted). Referring to FIGS. 1 and 6, the connector 600 comprises the high density angled or right angle header 600 for interconnecting the circuit assembly 522 having a plurality of contact areas 526 and a mating receptacle including a plurality of terminals with a plurality of first contact portions arranged in rows and columns in a receptacle housing, the receptacle further including at least one second side contact portion. Suitable connectors that can be used for mating with the connector 600 of the present invention are disclosed in U.S. patent application Ser. No. 07/536,855 filed Jun. 8, 1990 now abandoned, incorporated by reference.

Figure 2:
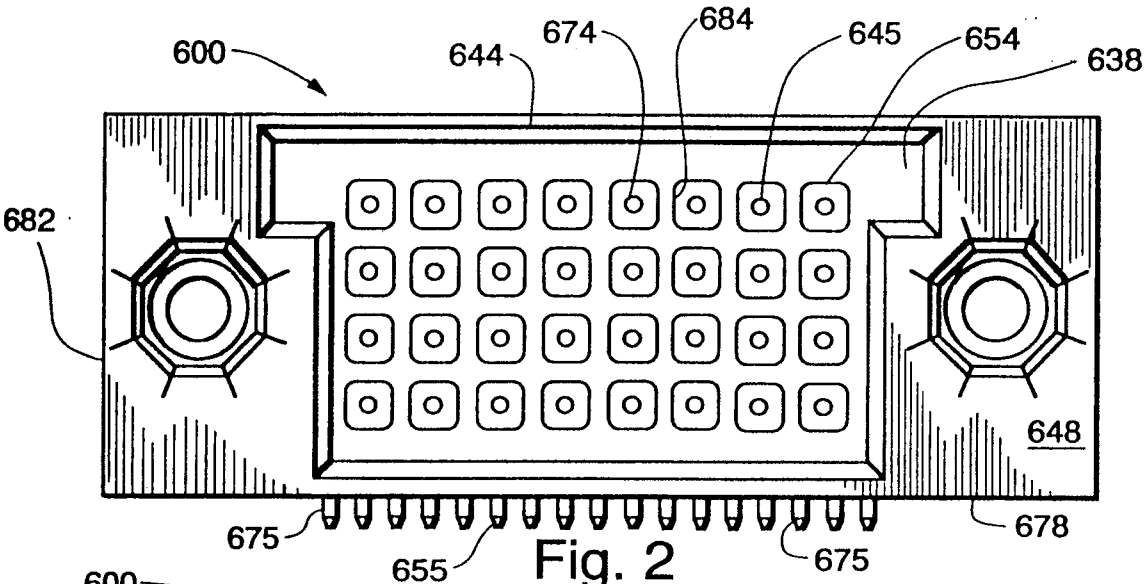
FIG. 2 is an enlarged view of a top or first mating side of the high density angled or right angle connector of FIG. 1.
Figure 4:
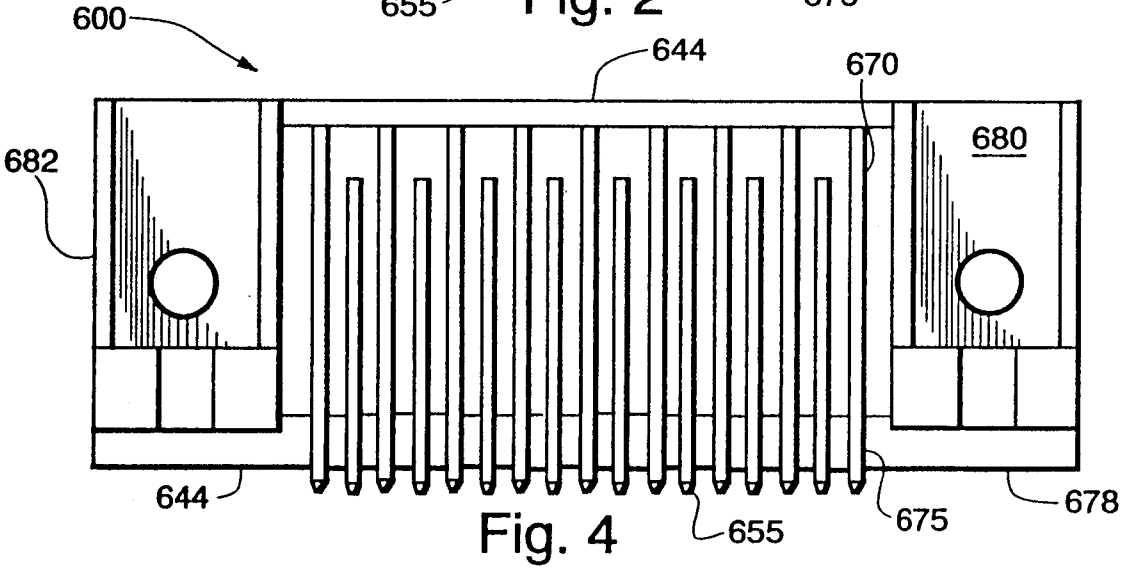
FIG. 4 is an enlarged view of a bottom side of the angled or right angle connector of FIG. 1.
Figure 3:
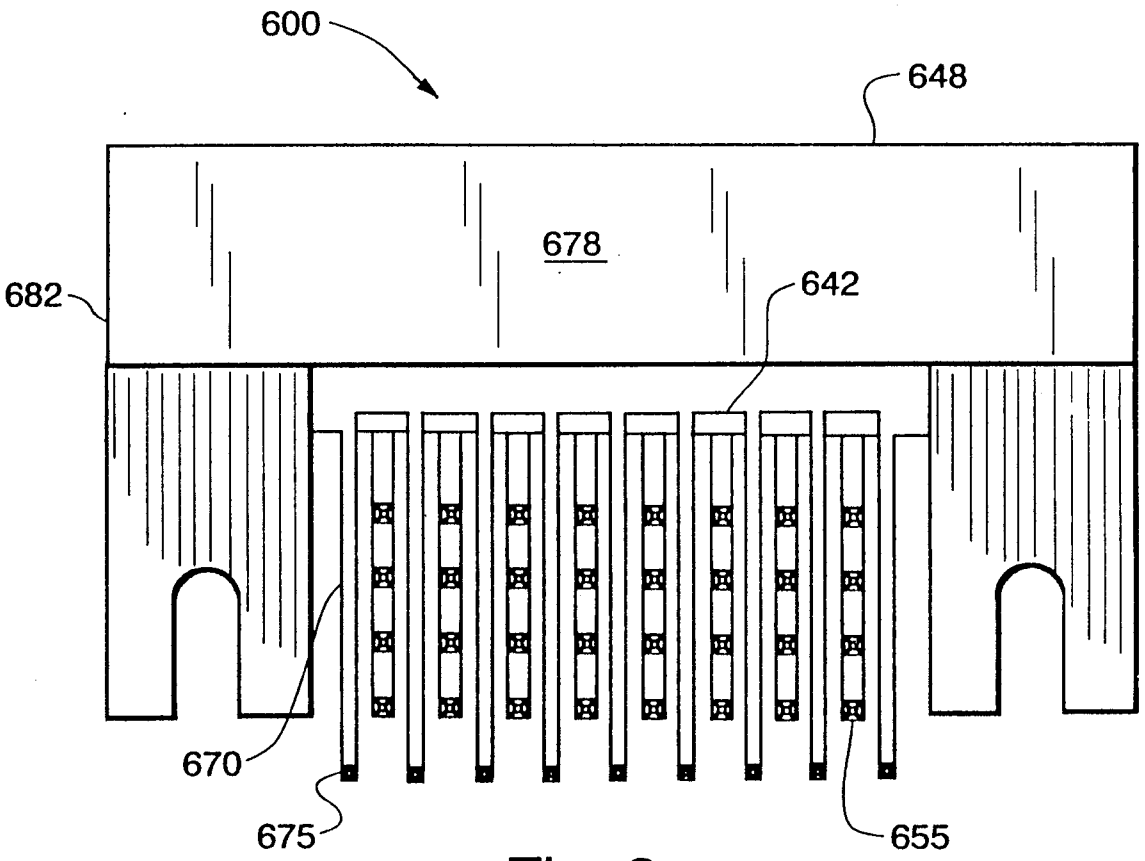
FIG. 3 is an enlarged view of a front or second mating side of the angled or right angle connector of FIG. 1.
Figure 5:
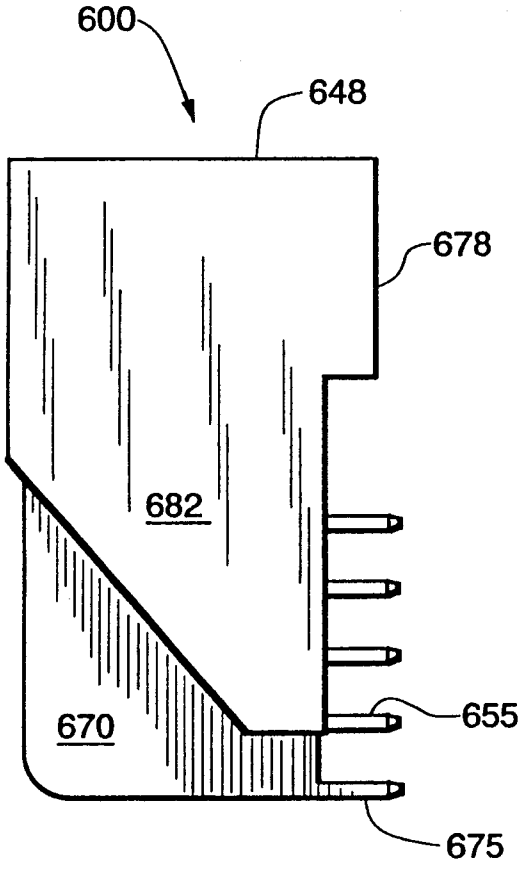
FIG. 5 is an enlarged view of an end of the angled or right angle connector of FIG. 1.

FIG. 2 is an enlarged view of a top or first mating side 648 of the high density angled or right angle 600 of FIG. 1. FIG. 3 is an enlarged view of a front or second mating side 678 of the angled or right angle header 600 of FIG. 1. FIG. 4 is an enlarged view of a bottom side 680 of the angled or right angle header 600 of FIG. 1. FIG. 5 is an enlarged view of an end 682 of the angled or right angle header 600 of FIG. 1. FIG. 6 is an enlarged cross sectional view of the header 600.

The angled or right angle header 600 comprises a plurality of conductive electrical contact elements 635; a housing 628 with a conductive base 638, insulative blocks 642 and at least one conductive baffle 670; and at least one baffle contact 675 extending from the conductive baffles 670.

The conductive electrical contact elements 635 may have any configuration so long as they are useable as angled or right angle contact elements. In other words, they may be male elements, female elements or gender neutral. More specifically, referring to FIGS. 1 and 6, each one of the electrical contact elements 635 has a first contact 645 and a second contact 655. Preferably, the first contacts 645 and the second contacts 655 are distal end portions of a pin generally having a 0.24 inches by 0.24 inches square cross section. One of the contact elements 635 is fixed in each passage 684 through the base 638 with the first contacts 645 positioned in a contact region 646 for contacting one of the contacts of a mating connector. The first contacts 645 are generally parallel to one another and arranged in rows and columns. There can be any number of rows and any number of columns of the first contacts 645. However, there are preferably at least two rows and at least two columns. Typically, there are three, four, five or six rows of the first contacts 645. The Figures depict four rows of the first contacts 645. Typically, there are many columns of the first contacts 645. Each one of the contact elements 635 has a middle portion 636 configured such that their second contacts 655 extend at an angle or perpendicularly with respect to the first contacts 645. The middle portions 636 may have a right angle bend, two 45 degree angle bends, etc. The second contacts 655 can be through mount contacts or surface mount contacts.

The conductive base 638 has a plurality of passages 684 arranged in rows and columns extending through the base 638. One of the contact elements 635 is fixed in each of the passages 684 with the first contacts 645 positioned on a first side of the base 638 in the contact region 646 for contacting one of the first contact portions of a mating connector. The second contacts 655 are positioned on a second side of the base 638. The insulative blocks 642 are positioned in the passages 684. The contact elements 635 are insulated from the base 638 by passing through the block passages 674 such that their first contacts 645 are on the first side of the base 638 and their second contacts 655 are on the second side of the base 638. The blocks 642 may comprise an insulative sleeve 654 surrounding each of the contact elements 635. The sleeves 654 associated with each column of the contact elements 635 may be connected to the same block 672. The baffles 670 may extend from the conductive base 638.

One of the conductive baffles 670 is positioned between and spaced from columns of the middle portions 636 of the contact elements 635. A baffle contact 675 may extend from each one of the conductive baffles 670 such that the second contacts 655 and the baffle contacts 675 are arranged in rows and columns for connecting to the contact regions 526 of the circuit assembly 522. The baffle contacts 675 can have the same or a different shape than the second contacts 655. For instance, both the second contacts 655 and the baffle contacts 675 can be pin shaped, but the cross section of one of them, such as the baffle contacts 675 can be larger than the cross section of the other. The baffle contacts 675 can be integrally cast out of the same metal with the base 638 and the baffles 670. Alternatively, the baffle contacts 675 can be conductive pins secured in holes in or through the baffles 670. A conductive wall (not depicted) may connect adjacent pairs of the baffles 670. The conductive wall can extend along the top and left sides of the baffles 670 in FIG. 6 substantially enclosing some or all of the bent portions 636 of the contact elements 635. The baffles 670 extend generally perpendicularly from the base 638.

The housing 628 may further comprise conductive side walls 644 extending generally perpendicularly from the base 638. The conductive side walls 644 comprise at least one third contact 665 for contacting the side contact portions of a mating connector. The third contacts 665 may be on interior surfaces of the side walls 644 or exterior surfaces of the side walls 644. In one embodiment, opposing interior surfaces of the conductive side walls 644 comprise the third contacts 665. The base 638 and the conductive side walls 644 partially enclose the contact region 646. The conductive base 638 can be described as a conductive lattice connected to and extending between the conductive side walls 644. The lattice 638 may be generally perpendicular to the conductive side walls 644.

The first contacts 645 of the high density header 600 can connect to any connector having a plurality of terminals or contact elements with a plurality of first contact portions arranged in rows and columns in a connector with at least one second side contact portion for engaging at least one of the third contacts 665. The connector that is mateable with the header 600 can be a vertical receptacle or an angled or right angle receptacle. Preferably, the terminals of the receptacle that is mateable with the header 600 have socket shaped contact portions for engaging the first contacts 645 of the header 600.

The circuit assembly 522 can be any assembly that includes a plurality of conductors, leads, plated through holes or conductive paths, pads or areas 526. The circuit assembly 522 can be a printed wiring board or a printed circuit board, such as a backpanel, a mother board or a daughter board. The circuit assembly 522 can be a cable assembly. The circuit assembly 522 can be rigid or flexible. In one typical situation, the header 600 is for electrically and mechanically interconnecting a backpanel or mother board 522 and a mating receptacle which, in turn, is for electrically and mechanically connecting to a daughter board that is perpendicular to the mother board 522.

It will be recognized by those skilled in the art that the ground structure of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetherimide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical connector for electrically and mechanically interconnecting a circuit assembly having a plurality of contact regions and a mating connector having first side walls, a plurality of first contact portions arranged in rows and columns within the first side walls and at least one second side contact portion, the electrical connector comprising:

a plurality of electrical contact elements wherein:

each of the contact elements has a first contact and a second contact, the first contacts are arranged in rows and columns for contacting the first contact portions, and each one of the contact elements includes a middle portion configured such that their second contacts extend at an angle with respect to the first contacts.

a housing including:

a conductive base having a plurality of passages arranged in rows and columns extending through the base, the contact elements positioned in the passages, a plurality of insulative blocks positioned in the passages, the having passages, the contact elements being in the block passages such that their first contacts are on a first side of the base in a contact region and their second contacts are on a second side of the base, and conductive baffles positioned between and spaced from columns of the middle portions of the contact elements, the baffles being connected to the conductive base.

2. The electrical connector of claim 1, further comprising:

a baffle contact extends from each one of the conductive baffles such that the second contacts and the baffle contacts are arranged in rows and columns for connecting to the contact regions of the circuit

3. The electrical connector of claim 1, wherein each one of the insulative blocks includes the block passages for holding a column of the contact elements.

4. The electrical connector of claim 1, wherein the blocks further comprise an insulative sleeve surrounding each of the contact elements.

5. The electrical connector of claim 1, further comprising:

conductive side walls extending from the base, the base and the conductive side walls partially enclosing the contact region.

* * * * *